United States Patent [19]

Wilson

[11] 4,031,822

[45] June 28, 1977

[54] PRINTING PRESS

[76] Inventor: Roy P. Wilson, 84 Cambridge St. North, Lindsay, Ontario, Canada

[22] Filed: Mar. 29, 1976

[21] Appl. No.: 671,133

[30] Foreign Application Priority Data

May 20, 1975 Canada ..... 227318

[52] U.S. Cl. ..... 101/53; 101/54; 101/72

[51] Int. Cl.² ..... B41L 45/08

[58] Field of Search ..... 101/47, 50, 52, 53, 101/54, 70, 216, 72, 76

[56] References Cited

UNITED STATES PATENTS

| | | | |
|---|---|---|---|
| 400,599 | 4/1889 | Robertson | 101/72 |
| 876,913 | 1/1908 | Rogers | 101/54 |
| 1,363,089 | 12/1920 | Cooper | 101/72 |
| 1,410,385 | 3/1922 | de Minico | 101/54 |
| 1,448,704 | 3/1923 | Chisholm | 101/54 |
| 2,037,181 | 4/1936 | Shomaker | 101/54 X |
| 3,020,837 | 2/1962 | Taylor et al. | 101/53 X |

*Primary Examiner*—Edward M. Coven

[57] ABSTRACT

A novel printing press for printing a large number of different messages on sequentially fed stock, without requiring the use of a large printing drum, which also eliminates the requirement for collating. A multiplicity of drum segments are provided each having similar radii of curvature, for carrying printing type on their convex surfaces. A pressure wheel is located adjacent a pressure plate, the pressure wheel having a similar radius of curvature as each of the drum segments. The drum segments are carried each in turn around at least part of the pressure wheel between the pressure wheel and pressure plate, whereupon stock fed therebetween can be imprinted.

5 Claims, 3 Drawing Figures

PRINTING PRESS

Figure 1:
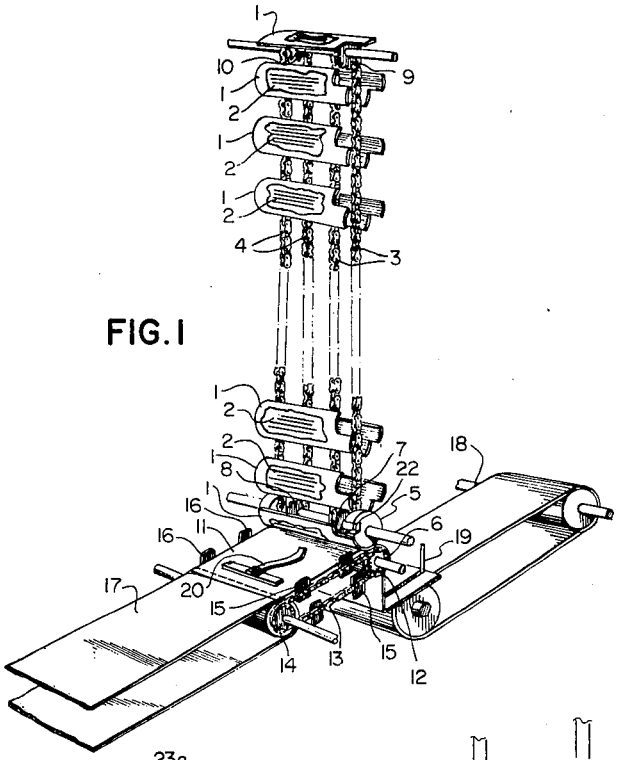

This invention relates to a novel printing press particularly useful for printing sequences of sheets of paper or articles with different messages.

The normal printing press, such as letterpress, offset, etc. utilizes a cylindrical printing drum, which revolves against a pressure plate or pressure drum. Paper stock to be printed is drawn between the cylindrical drum and pressure plate as the drum revolves, imprinting repetitively each piece of paper with the same message.

In order to imprint different pages of a multi-page publication at the same time, sometimes two or four pages of print are placed in a pattern on the printing drum. After imprinting, the paper which has been printed is cut up and collated.

Another technique of making multi-page publications is to print large numbers of the same page, then change the type and print the same number of pages with a different message, etc. After all the pages containing different messages have been completely printed, collating is done at which time the pages are placed in their proper order, and then the publication is bound.

It is clear that collating the pages is a time consuming step which is preferably dispensed with, and it can result in error in the event of misplacement of one or more of the sheets. For certain applications, it is desirable to print all of the pages sequentially, then merely stack the pages in the normal order in which they are printed. The latter technique is particularly desirable where such items as church envelopes are to be printed, in which sequential envelopes have specific messages by the week, occasion, and date. It is particularly useful where different churches mark different occasions, and consequently the special occasion envelopes used in different churches are not the same. In this case, it is highly desirable to be able to print series of envelopes in which only a small number differ from church to church, but in high volume, and without the requirement for collating a full year's series together.

To use the prior art method of placing the type for perhaps 52 or more sequentially different envelopes around a drum would result in a printing drum of unmanageable size. For instance, to print an envelope of about 6 inches × 4 inches 52 different 4 inch maximum different messages of print would result in a drum diameter of, for example, 5 or 6 feet, by a length of about 6 or 8 inches.

The present invention is directed to a printing press for printing a large number of different kinds of messages on sequential items such as church envelopes, without the requirement for a large diameter and a short length of printing drum. The type can be changed readily, and the entire machine is of manageable size. The requirement for collating is eliminated.

The invention comprises a multiplicity of drum segments, each having similar radii of curvature, for carrying printing type on their convex surfaces, in combination with a pressure wheel which has a similar radius of curvature as each of the drum segments and a pressure plate located adjacent the pressure wheel. Means is provided for carrying each of the drum segments in turn around at least part of the pressure wheel, between the pressure wheel and the pressure plate. As each individual drum segment is carried around the pressure wheel, a sheet of paper is passed below and is imprinted. Since each individual drum segment can carry a different message, each sequential sheet of paper can be printed with a different message.

Since the radius of curvature of each individual drum segment is substantially smaller than would be the case of a single drum carrying each message in sequence, the entire assembly can be assembled relatively extremely compactly, the large printing drum being eliminated.

Figure 3:
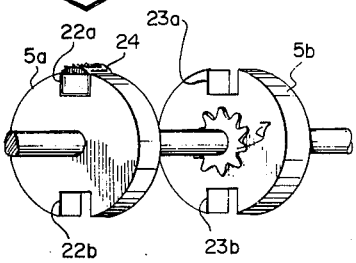
Figure 2:
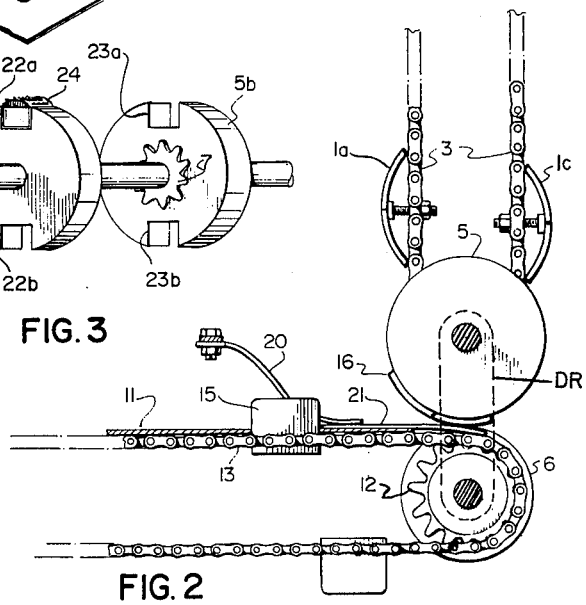

More particularly, a pair of sprocket wheels are mounted with their axes coaxial with the axis of the pressure wheel. Each of a pair of chains is disposed orthogonal and around the respective sprocket wheels, having the sprocket holes integrated with the respective sprocket wheels. The drum segments are mounted to and across both chains, the axes of the drum segments being parallel to the pressure wheel axis. Therefore upon rotation of the sprocket wheels, the chains are progressively drawn around the axis of the pressure wheel in unison, and the drum segments are sequentially drawn around part of the pressure wheel and between the pressure wheel and the pressure plate. A better understanding of the invention will be obtained by reference to the description below of the preferred embodiment of the invention, and to the appended drawings, in which:

FIG. 1 is an isometric view of the printing press with its frame deleted,

FIG. 2 is a side elevation detail showing the environment of the pressure wheel and pressure plate, and FIG. 3 is a detail of the preferred form of the pressure wheel. Turning first to FIG. 1, there is shown a multiplicity of drum segments 1, each having similar radii of curvature. Each of the drum segments is adapted to carry printing type 2. For instance, different messages are formed by raised rubber lettering on a rubber base, each individual base being adherent to the individual drum segments 1. Clearly they can be changed as desired.

The drum segments are orthogonally fastened across a pair of loops such as loops comprised of bicycle chains 3 and 4. While any non-extensible material which can form a similar kind of loop can be used, bicycle chain is preferred since it is inexpensive, wears very little, is strong, reliable, and can easily be driven by a sprocket wheel.

A pressure wheel 5 is provided which has a similar radius of curvature as each of the drum segments 1. Disposed adjacent the pressure wheel 5 is a pressure plate 6, which is preferably in the form of a drum. The drum segments 1 are carried by the chains and are caused to pass around the pressure wheel 5 between the pressure wheel and pressure plate 6, whereby the printing type 2 can impress a piece of material such as an envelope passing therebetween, and simultaneously with the envelope be progessively drawn therebetween.

In order to cause the drum segments 1 to pass around the pressure wheel 5, it is preferred that the pressure wheel be split into two short cylinders, displaced a distance less than the width of each of the drum segments. Between the segments of the pressure wheel, and preferably mounted on the same axis are a pair of sprocket wheels 7 and 8 around which the respective chains 3 and 4 are drawn. It is preferred that the sprocket wheels are of shorter diameter than the diameter of the pressure wheel 5, to the extent that when the chain and the drum segments are drawn around, the drum segments 1 will be firmly held to the periphery of the pressure wheel segments. This diameter will vary for individual structures, depending on the preferred manner of fastening the drum segments to the chain, the sprocket size, chain size, etc.

Of course, a second pair of sprocket wheels 9 and 10 are disposed at a position which will render the chain taut, the more important requirement being that the chain is fed to sprocket wheels 7 and 8 with a minimum of slack in order that it not come off or slip from them.

While sprocket wheels 9 and 10 are shown in their preferred location, in a location such that the loops of chain 3 and 4 run vertically, it is clear that the chain could be directed through a folded path, as may be desired in making the machine more compact or for inking purposes. It should be noted that any standard inking process, such as by contact by printing type 2 with an ink-saturated wheel can be used, and since inking structures are expected to be known to one skilled in the art, it will not be described further.

It had been pointed out that the preferred form of the pressure plate 6 is a drum, which has length at least equal to the width of the drum segments 1. A stock feeding plate 11 is located with its front edge close to the surface of pressure plate 6, its plane being parallel to but substantially higher than orthogonal to the axis of the drum pressure plate. Stock material such as envelopes to be imprinted pass across the feeding plate 11, into engagement with the printing type 2 carried by drum segment 1, and is compressed and carried between pressure wheel 5 and pressure plate 6.

While the envelopes can be fed into the above-described printing mechanism by other means, it is preferred that the following mechanism be used. Each one of a pair of sprocket wheels 12 is disposed on the same axle as drum pressure plate 6 and on opposite sides thereof. Each one of a pair of chains 13 is carried by the respective one of the pair of sprocket wheels 12, and at least one edge of the chain is caused to run parallel with the plane of feeding plate 11, but below the surface thereof. This can be constructed by providing a fourth pair of sprocket wheels 14 which is carried by an axle located in front of the opposite outer edge of feeding plate 11.

Attached to chains 13 at regular longitudinal intervals are tabs 15 and 16, which extend upwardly higher than the surface of feeding plate 11. Pairs of tabs 15 and 16 are located opposite each other, a line joining their leading edges being parallel to the axis of the pressure wheel. As the chains advance, the tabs 15 and 16 advance in unison therewith.

The location of sprocket wheels 12 must be such as to allow tabs 15 and 16 to pass therearound without interference with the pressure wheel 5. Clearance will exist if they are slightly outwardly displaced from the outer edges of pressure wheel 5.

The function of tabs 15 and 16 are to push the trailing edge of stock such as an envelope into engagement with the printing mechanism. Therefore the distance between tabs 5 and 6 must be less than the width of the envelope, and this will also dictate the width of feeding plate 11. However, it is clear that feeding plate 11 can be split into parts with side portions located outwardly from the path taken by tabs 15 and 16, which will result in accommodating slots being formed between feeding plate 11 and its outward side portions (not shown).

Envelopes can be fed to feeding plate 11 by any suitable means, such as by moving belt 17, which can revolve around a drum having the same axis as sprocket wheels 14.

Printed envelopes having egressed from the printing mechanism will fall to a surface below and be piled in sequence, or as may be desired, using conventional means. A moving belt 18 can be provided with stabilizing bars 19 adapted to aid a neat stacking process. Conventional means can also be provided for advancing the moving belt 18, carrying the stack of envelopes a predetermined distance, when the first in line of the drum segments has made a complete revolution to the pressure wheel once having egressed therefrom. A completely collated stack of envelopes or other printed material is thus produced, with no need of the further step of collating.

In operation, the axles for pressure wheel 5 and pressure plate drum 6 are driven in opposite directions in unison by any suitable means DR known by one skilled in the art. Envelopes which have been placed, preferably by automatic means, in sequence on moving belt 17 are passed to feeding plate 11. As the pressure plate drum 6 revolves, pair of chains 13 turns carrying tabs 15 and 16 therewith. The trailing edge of an envelope on feeding plate 11 is caught by tabs 15 and 16, which push it uniformly toward the printing mechanism. As successive envelopes are passed by moving belt 11 or other means to the feeding plate 11, successive pairs of tabs catch their trailing edges, feeding them successively, at a prescribed spacing corresponding to the spacing of the drum segments 1, steadily to the printing mechanism.

The envelopes or other stock shall maintain a low profile on feeding plate 11 for proper feeding of the printing mechanism, and therefore it is preferred that means such as leaf spring 20 be fixed with biased pressure against feeding plate 11. As envelopes are pushed forward, they pass between leaf spring 20 and feeding plate 11, and consequently are properly fed into the printing mechanism. In addition, leaf spring 20 pushes the envelopes back against the tabs 15 and 16, maintaining their proper spacing.

As an envelope is fed into the printing mechanism at exactly the correct location, a drum segment 1 and the printing type adherent thereto comes into contact with it, and it is drawn between the print and pressure plate drum 6. Due to the similar radii of curvature of pressure wheel 5 and drum segment 1, the drum segment revolves therearound and printing pressure is applied to the drum segment and the envelope. Once the imprinting has occurred, the envelope completes its engagement and falls below into a stack on moving belt 18 or another base, and is kept in line by stabilizing bars 19.

FIG. 2 shows in side elevation the detail of the printing and envelope feeding mechanism. Drum segments 1A, 1B, and 1C are affixed by welded bolts or other means to chain 3. Drum segment 1B is shown in engagement with pressure wheel 5, and pressure plate drum 6.

Chain 13, carrying tab 15 is shown longitudinally running parallel, and slightly below feeding plate 11, and passing around sprocket wheel 12 which is affixed to the same axle as pressure plate 6. Feeding plate 11 is shown cross-hatched for clarity.

The trailing edge of envelope 21 is pushed by the front edge of tab 15, and is held down by leaf spring 20 for proper feeding between drum segment 1B and pressure plate drum 6 and good contact with tab 15.

It should be understood that the spacing between the leading edges of tabs 15, and the spacing between drum segments 1 must be identical, in a structure in which the envelopes are advanced at the same rate as the drum segments. Alternatively, if the advancement of the envelopes is at a faster speed, their spacing relative to the drum segment spacing must be inverse to the ratio of the drum segment to tab velocities.

It was noted eariler that both the pressure wheel 5 and pressure plate 6 axles, the latter from which sprocket wheel 12 obtains its power, can be run from the same power source. It is preferable that an external adjustment as to the relative positions of predetermined radii on each, relative to each other be made in case the tolerances of the positions of the drum segments on their respective chains and the distance between tabs 15 add up so as to cause progressively lower or higher printing to occur on successive envelopes, relative to their front edges. This adjustment can be provided by the use of a slip clutch, differential movement between a pair of gears respectively driving the pressure wheel and pressure plate drum, or the like, in a well known manner.

It is often required to print successively advancing or changing dates or serial numbers on successive envelopes. In this case it is preferable to accommodate a serial counter and printer in a slot 22 in the periphery of pressure wheel 5. This slot is shown in FIG. 1, and in more detail in an enlarged view of pressure wheel 5 by itself in FIG. 3.

In FIG. 3, the pressure wheel is split into two short cylinders 5A and 5B, as in the preferred embodiment described earlier, joined by an axle. Disposed on the axle is sprocket wheel 7 for accommodating a chain.

Each of the short cylinders 5A and 5B contain two slots, 22A and 22B, and 23A and 23B. A serial counter and printer 24 of well known type is inserted and locked by friction, a clamp, or a bolt into slot 22A. The printer contains its own independently revolving drum, which itself carries a date or other indicia. Each time pressure wheel 5 revolves around once, a tab from the frame of the press contacts and advances the printing wheel on the counter 24, whereupon the next envelope will have an advancing date, number, etc. printed thereon. With four or more slots in the entire pressure wheel, four or more different advancing indicia can be printed thereon.

It may now become clear to one skilled in the art understanding this invention that the basic principles of this invention can be utilized in different forms. All such forms falling within the ambit of the appended claims are considered to be part of the spirit and scope of this invention.

The embodiments of the invention in which an exclusive property or privilege is claimed are defined as follows:

1. A printing press comprising:

a. a multiplicity of drum segments, having similar radii or curvature, for carrying printing type on their convex surfaces, b. a pressure wheel comprised of two spaced coaxial cylindrical portions, each having a similar radius of curvature as each of the drum segments, at least one cylindrical portion containing a slot which accommodates a sequential count changing and printing apparatus, each of the drum segments containing a gap to accommodate the protrusion of type from said count changing and printing apparatus, c. a pressure plate located adjacent the pressure wheel, d. a pair of spaced sprocket wheels having a smaller diameter than the diameter of said pressure wheel portions mounted with their axes coaxial with the axis of the pressure wheel between the cylindrical portions, e. a pair of chains disposed orthogonal and around the respective sprocket wheels, each having sprocket holes integrated with the respective sprocket wheels, the width across the outside of the chains through a diameter of the sprocket wheels being less than the diameter of the pressure wheel, f. means mounting the drum segments to both chains, the axes of the drum segments being parallel to the pressure wheel axis, whereby, upon rotation of the sprocket wheels, the chains are progressively drawn around the axis of the pressure wheel in unison, and the drum segments are sequentially drawn around and bear upon part of the pressure wheel between the pressure wheel and the pressure plate to imprint stock passing therethrough, while the sequential count changing and printing apparatus simultaneously imprints and further indexes.

2. A printing press as defined in claim 1, further including a second pair of sprocket wheels disposed on a common axis of engagement with the sprocket holes of the chains at a remote location from the frist pair of sprocket wheels, whereby the chains are held tautly between the first and second pairs of sprocket wheels at least in the direction of feeding the chains to the first set of sprocket wheels, the pressure plate being in the form of a drum having an axis parallel to the axis of the pressure wheel.

3. A printing press as defined in claim 2, further including a feeding plate for carrying material to be printed, located with its surface extending outwardly from the surface of the pressure plate drum adjacent the pressure wheel; further including means for pushing individual pieces of material to be printed along the surface of the feeding plate between the pressure plate drum and pressure wheel in coincidence with individual drum segments rotating around the pressure wheel, whereby the individual pieces of material can be squeezed, imprinted, and carried between and past the pressure plate drum and printing type carried by the drum segments and by the count changing and printing apparatus within the pressure wheel.

4. A printing press as defined in claim 3, in which said means for pushing comprises a pair of flexible, non-extensible bands having a portion thereof carried parallel to and slightly under the surface of the feeding plate on opposite sides thereof, each of the bands carrying tabs at parallel positions with respect to the axis of the pressure plate drum, extending higher than the surface of the feeding plate; further including means for moving said bands in unison toward the drum, whereby the trailing edge of a piece of material to be printed is pushed by said tabs along the surface of the feeding plate directly into engagement with the pressure plate drum and drum segments.

5. A printing press as defined in claim 4, in which each of said bands is a chain; further including a third pair of sprocket wheels of diameter narrower than the pressure plate drum located coaxial therewith each on opposite sides thereof, each of the third pair of chains being in respective engagment with the sprocket wheels, further including a fourth pair of coaxial sprocket wheels in engagement with the chains at a position such as to cause a length of each chain at least equal to the length of the feeding plate to be disposed in taut parallel relationship on respective sides thereof orthogonal to the axis of the pressure plate drum; the longitudinal distance between said tabs being the same as the distance between each of the drum segments, and further including means for frictionally retarding the movement vertically and horizontally of a piece of material to be printed in order to force engagment of its trailing edge with a pair of said tabs as said chain is caused to advance.

* * * * *